US008020261B2

(12) United States Patent
Takani et al.

(10) Patent No.: US 8,020,261 B2
(45) Date of Patent: Sep. 20, 2011

(54) CONCEALED TYPE SLIDE FASTENER

(75) Inventors: Go Takani, Toyama-Ken (JP); Masaya Yokomoto, Toyama-Ken (JP)

(73) Assignee: YKK Corporation (JP)

( * ) Notice: Subject to any disclaimer, the term of this patent is extended or adjusted under 35 U.S.C. 154(b) by 868 days.

(21) Appl. No.: 12/042,410

(22) Filed: Mar. 5, 2008

(65) Prior Publication Data

US 2008/0222855 A1 Sep. 18, 2008

(30) Foreign Application Priority Data

Mar. 15, 2007 (JP) ..... 2007-067224

(51) Int. Cl.
*A44B 19/38* (2006.01)

(52) U.S. Cl. ..... 24/433; 24/434

(58) Field of Classification Search ..... 24/433, 24/434, 432, 585.1, 585.11
See application file for complete search history.

(56) References Cited

U.S. PATENT DOCUMENTS

| | | | | |
|---|---|---|---|---|
| 5,388,312 | A * | 2/1995 | Fudaki | 24/433 |
| 6,131,250 | A | 10/2000 | Fan et al. | |
| 6,704,975 | B2 * | 3/2004 | Matsumoto et al. | 24/434 |
| 2006/0075612 | A1 | 4/2006 | Wu | |

FOREIGN PATENT DOCUMENTS

| | | |
|---|---|---|
| EP | 1088491 | 4/2001 |
| JP | 2003-180411 A | 7/2003 |

* cited by examiner

*Primary Examiner* — Robert Sandy
(74) *Attorney, Agent, or Firm* — Kilpatrick Townsend & Stockton LLP

(57) ABSTRACT

A concealed type slide fastener comprising a box, a box pin and an insert pin, wherein the box includes an insert pin insertion/removal space into/from which the box insertion/removal portion of the insert pin is inserted and removed, an engaged/disengaged portion with/from which an engaging/disengaging portion of the insert pin is engaged and disengaged, the insert pin insertion/removal space of the box and the engaged/disengaged portion are separated from each other through a partition wall, an end portion of the partition wall on the box pin side has a notch portion for guiding the side wall portion of the insert pin throughout an entire length, and tape folding end sides of the box insertion/removal portion and the engaging/disengaging portion of the insert pin are connected throughout at least the entire length of the engaging/disengaging portion by a side wall portion.

3 Claims, 6 Drawing Sheets

CONCEALED TYPE SLIDE FASTENER

INCORPORATION BY REFERENCE

The present application claims priority under 35 U.S.C. §119 to Japanese Patent Application No. 2007-067224 filed on Mar. 15, 2007. The content of the application is incorporated herein by reference in its entirety.

BACKGROUND OF THE INVENTION

1. Field of the Invention

The present invention relates to a concealed type slide fastener having a fastener stringer in which opposing side edges of a pair of right and left fastener tapes are bent into a U shape along a length direction thereof while a plurality of fastener elements are attached along the bent side edges. More particularly, the invention relates to a concealed type slide fastener having a feature in a structure of a separable end stop comprising a box pin and an insert pin formed of a thermoplastic synthetic resin and integrally formed with each end portion in a length direction of the pair of fastener stringers and a box integrated with the box pin so that the insert pin can be inserted into and removed from the box.

2. Description of Related Art

In an ordinary slide fastener, a pair of fastener stringers configured such that a plurality of fastener elements are attached along opposing side edges of a pair of right and left fastener tapes are made to pass through a slider, and the slide fastener is opened or closed by engaging the right and left fastener elements or releasing the engagement by the sliding operation of the slider. To define the sliding limit of the slider, end stops are formed at both end portions in the length direction of the slide fastener.

To the contrary, in a concealed type slide fastener, opposing side edges of a pair of right and left fastener tapes are bent into a U shape in cross section along a length direction thereof. With the shape fixed, a plurality of fastener elements are attached along an outside face of the U-shaped folded portion at a predetermined pitch, thereby forming fastener stringers. End stops are formed on both end portions in the length direction of the fastener stringer like the ordinary slide fastener.

Ordinary end stops include a top end stop which always keeps end portions of the right and left fastener stringers in a separated state and a bottom end stop which always keep the end portions of the right and left fastener stringers in a coupled state. The separable end stop is a kind of the bottom end stop. When an insert pin is removed from a box and pulled out of a slider also in order to release the slide fastener, the right and left fastener stringers can be completely separated from each other. When the insert pin is inserted into the box through the slider, the right and left fastener stringers are joined together through the box pin and box. By sliding the slider, opposing fastener elements of the separated right and left fastener stringers are engaged together to close the slide fastener.

The separable end stop of the concealed type slide fastener has a peculiar structure different form the separable end stop of the ordinary slide fastener. This originates from the tape folding structure of the fastener stringer in the concealed type slide fastener and the slider structure suitable for the folding structure. The slider of the concealed type slide fastener has no upper blade which is exposed on the surface of a product, but has right and left flanges L shaped in cross section. The flanges L rise toward the front surface of the product from right and left ends of a lower blade disposed on the rear side of the product so that the flanges are bent at right angle in directions in which they approach each other. The slider further includes a post rising toward the front surface of the product from the center of one end portion of the lower blade and having a pull tab attaching portion at a front end thereof. A Y-shaped space formed between the lower blade and the flange having the L-shaped section serves as an element guide passage.

When the slider of the concealed type slide fastener is slid, fastener element rows are guided into the Y-shaped element guide passage in the slider and need to be introduced with the tape main body side of the U-shaped folded portion of the fastener tape extracted out from a gap between the flange of the slider and the post. More specifically, when coupling the separable end stop, an insert pin attached to the end portion of one fastener stringer needs to be made to pass through the space portion formed between the flange having the L-shaped section of the slider and the lower blade, and then inserted into an insert pin insertion space of a box attached to the end portion of the other fastener stringer. At this time, the insert pin is easy to insert if constituted of a single rod-like body. However, when a force (lateral pulling force) in a direction crossing the element row of the slide fastener is applied to the fastener tape, the insert pin is apt to roll inside the box as described in, for example, Japanese Patent Application Laid-Open (JP-A) No. 2003-180411 (patent document 1).

The separable end stop according to the patent document 1 is constituted of two components, a box insertion/removal portion which is inserted into the insert pin insertion space of the box in order to block the insert pin from rolling inside the box when a lateral pulling force is applied, and an engaging/disengaging portion which is engaged with or disengaged from the box insertion/removal portion across the flange of the slider. On the other hand, a wall portion is formed on the box between the insert pin insertion space in which the box insertion/removal portion of the insert pin is to be inserted and the engaging/disengaging portion with which the engaging/disengaging portion engages. Consequently, the box insertion/removal portion and the engaging/disengaging portion are separated such that the wall portion is sandwiched between the box insertion/removal portion and the engaging/disengaging portion when the box insertion/removal portion of the insert pin is inserted into the insert pin insertion space. In addition, lateral grid-like reinforcing portions are formed integrally on the surface of the tapes opposite to the element attaching side, continuous from the insert pin and the box pin at the same time. With such a structure, even if a lateral pulling force is applied to the slide fastener after the insert pin is inserted into the box, such a fault that the insert pin rolls inside the box is eliminated.

In the concealed type slide fastener described in the patent document 1, the insert pin is inserted into the box such that the box insertion/removal portion and engaging/disengaging portion of the insert pin stride over the wall portion of the box, and consequently, the insert pin is never rolled by the lateral pulling force described above.

In the concealed type slide fastener described in the patent document 1, however, the box insertion/removal portion and the engaging/disengaging portion are completely separated from each other. For this reason, when the box insertion/removal portion is inserted through the space formed between the lower blade of the slider and the flange having a L-shaped section, the lower blade of the slider is likely to be caught between the box insertion/removal portion and the engaging/disengaging portion by mistake, with the result that if an attempt is made to push the portion strongly, a branch portion between the box insertion/removal portion and the engaging/ disengaging portion can be broken as if it is torn out. When the insert pin is attempted to be inserted into the insert pin insertion space of the box, the engaging/disengaging portion is caught by the wall portion of the box. As a result, the engaging/disengaging portion cannot be inserted smoothly up to an engaged/disengaged portion of the box and further, if an attempt is made to push the portion forcibly, the engaging/disengaging portion can be broken.

Further, the box insertion/removal portion and the engaging/disengaging portion of the insert pin are completely separated from a base portion. Therefore, for example, when a strong upward pushing force is applied, the engaging/disengaging portion is deformed elastically and slips out of the box, whereby the coupling state between the right and left fastener stringers is likely released to separate the right and left fastener stringers.

SUMMARY OF THE INVENTION

The present invention has been achieved to solve the above-described problems, and an object of the invention is to provide a separable end stop having a structure peculiar to a concealed slide fastener, and more specifically, a concealed type slide fastener having a separable end stop configured such that an insert pin can be smoothly and precisely inserted into a box, the separable end stop being hard to deform or damage even if a lateral pulling force or an upward pushing force is applied.

The foregoing object is achieved by a concealed type slide fastener provided with a separable end stop comprising:

a box integrally molded on each fastener tape extending from one end portion in a length direction of each fastener tape of a fastener stringer in which opposing side edge portions of a pair of fastener tapes are bent into a U shape along the length direction thereof and a plurality of fastener elements are attached along a folding end portion; a box pin fixed to the box; and an insert pin that is insertable into the box. The box comprises an insertion/removal space into/from which a part of the insert pin is inserted and removed, and an engaged/disengaged portion with/from which the other part of the insert pin is engaged and disengaged. The part of the insert pin is a box insertion/removal portion which is inserted into and removed from the insertion/removal space of the box. The other part of the insert pin is an engaging/disengaging portion which is disposed in parallel to the box insertion/removal portion with a gap and is engaged with and disengaged from the engaged/disengaged portion of the box. The insertion/removal space and the engaged/disengaged portion of the box are disposed to be separated from each other through a partition wall. Tape folding end sides of the box insertion/removal portion and the engaging/disengaging portion of the insert pin are connected by a side wall portion throughout at least an entire length in a longitudinal direction to the bottom end of the engaging/disengaging portion. A notch portion for guiding the side wall portion of the insert pin throughout an entire length of the side wall portion is provided at an end portion of the partition wall of the box on the box pin side.

According to a preferred aspect, a dimension of the gap between the box insertion/removal portion and the engaging/disengaging portion of the insert pin is set larger than the thickness of the partition wall of the box. Further, preferably, the side edge of the partition wall on a notch portion side is set to oppose the side wall portion.

According to the present invention, the box insertion/removal portion and the engaging/disengaging portion of the insert pin are connected by the side wall portion at least throughout the entire length, and further, the box includes the notch portion for guiding the side wall portion throughout the entire length in a longitudinal direction to the bottom end of the box pin side end portion of the partition wall for separating the insertion/removal space into/from which the box insertion/removal portion of the insert pin is inserted into and removed from the engaged/disengaged portion. Consequently, when the insert pin is inserted into the box through the slider, a lower blade of the slider is never caught between the box insertion/removal portion and the engaging/disengaging portion of the insert pin different from the patent document 1. In addition, the side wall portion of the insert pin is guided securely to the notch portion of the side wall portion, so that the box insertion/removal portion and the engaging/disengaging portion of the insert pin are never caught by the partition wall of the box, whereby the insert pin can be inserted securely and extremely smoothly into the box.

Further, even after the insert pin is inserted into the box, reinforcement is obtained by the box insertion/removal portion, the engaging/disengaging portion and the side wall portion because the box insertion/removal portion and the engaging/disengaging portion of the insert pin are connected by the side wall portion at least having the same length as the extending length of the engaging/disengaging portion. Consequently, even if a force of attempting to separate the box insertion/removal portion from the engaging/disengaging portion is applied, the insert pin is never destroyed or deformed easily, so that the insert pin is difficult to separate from the box, whereby the durability of the concealed type slide fastener is improved extremely.

DESCRIPTION OF THE PREFERRED EMBODIMENTS

Hereinafter, a typical embodiment of a concealed type slide fastener of the present invention will be described with reference to the accompanying drawings.

Figure 1:
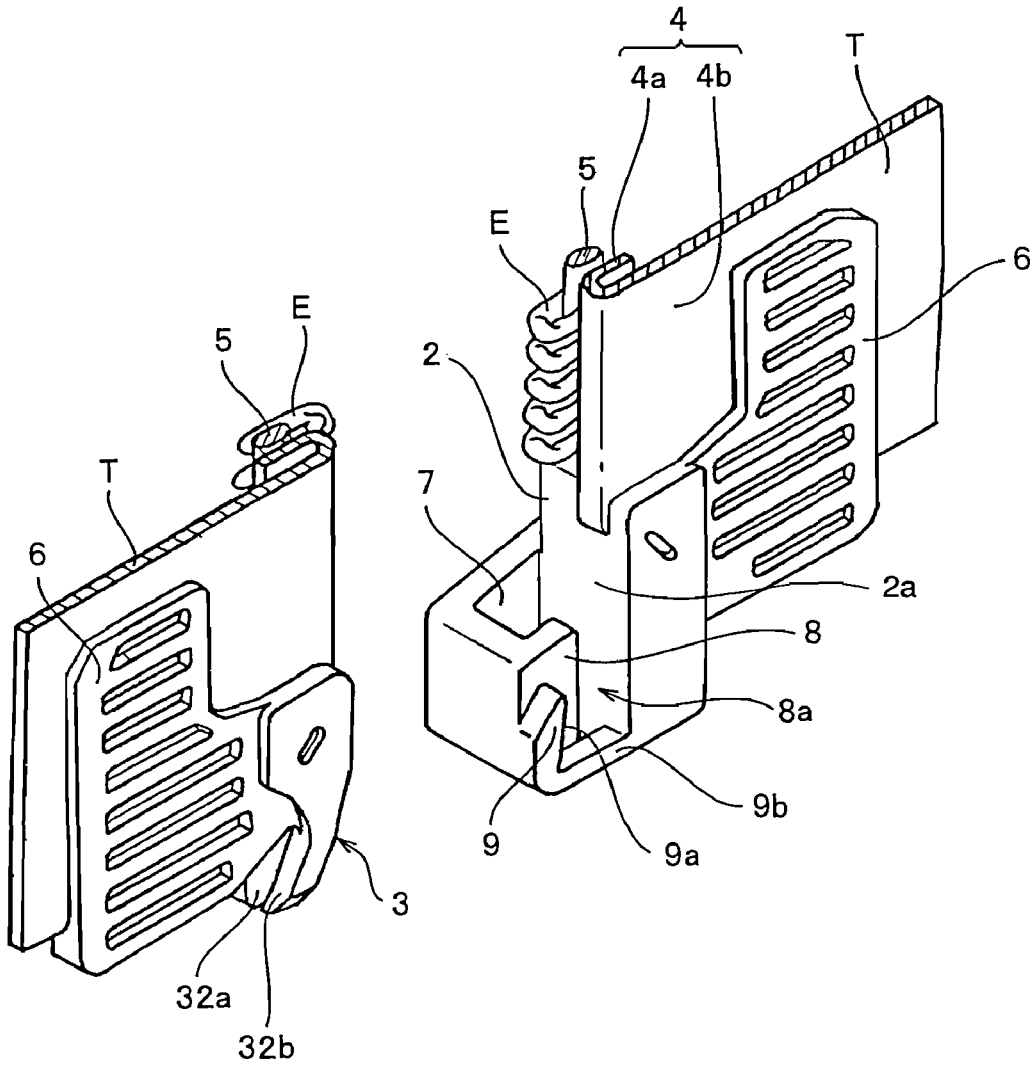
FIG. 1 is an exploded perspective view of a separable end stop mounting end portion of a concealed type slide fastener.

A separable end stop of the concealed type slide fastener of the invention is comprised of three components, a box 1, a box pin 2 and an insert pin 3 as shown in FIG. 1. According to the indicated embodiment, the box pin 2 and the insert pin 3 are formed integrally on each end of a pair of right and left fastener tapes by injection molding using a thermoplastic resin such as polyamide, polyacetal, polypropylene and polybutylene terephthalate. As described in the patent document 1, it is permissible to form the box pin and insert pin at each end of the pair of fastener stringers and form the box having a box pin insertion space and an insert pin insertion space separately from the box pin and then insert the box pin into the box pin insertion space of the box so that the box pin is engaged with an engaged portion (not shown) in the box pin insertion space such that the box pin cannot be pulled out.

The pair of right and left fastener tapes T entirely presents letter J shape with its opposing side edge portions being bent into U shape along the length direction. A plurality of fastener elements E are attached along the surface of a folding edge piece 4*a* of a folded end portion 4 of the fastener tape T with sewing thread. The fastener elements E are molded by forming a synthetic resin monofilament into a coil-like or zigzag-like configuration. The fastener element E is comprised of a coupling head which is engaged with and disengaged from a mating fastener element E, a pair of leg portions extending in a direction from the coupling head, and a connecting portion for connecting the leg portion of adjoining elements so as to form a continuous fastener element row ER. A core thread 5 made of knit fibers is inserted through the coil-like fastener element row ER and sewed to the fastener tape T with a sewing yarn (not shown) such that the sewing yarn rides over the fastener element E. With the core thread sewed, the coupling head of the fastener element E is projected out from the folded end portion 4.

In the indicated example, the box pin 2 presents a substantially rectangular column shape, and is formed integrally such that it is projected in the length direction of the tape from one end of the fastener tape T, adjoining the fastener element E attached to the folded end portion 4 of one fastener tape T. A lateral grid-like reinforcing portion 6 extending integrally from a side face of the box pin 2 is formed on the surface of the folded end portion 4 of the fastener tape T on the tape main body 4*b* side provided with no fastener element E like the separable end stop described in the patent document 1.

As shown in FIG. 1, the box 1 presents a cubic box shape in which a face of the box pin 2 opposing the insert pin 3 serves as an inside wall face 2*a*. The box 1 forms an insert pin insertion/removal space 7 whose top face is open so that a part of the insert pin 3 is inserted into or removed from the space 7. A partition wall 8 disposed on the front face side (forward side in FIG. 1) of the wall portion surrounding the insert pin insertion/removal space 7 has a notch portion 8*a* which is cut out continuously from the top end to the bottom end with a required width on an end portion on the inside wall face 2*a* of the box pin 2. An edge portion along a longitudinal direction of the fastener tape T is formed in the partition wall 8 by the notch portion 8*a*. The width of the notch portion 8*a* is set larger than the thickness of a side wall portion 32*c* described later of the insert pin 3, and the depth of the notch portion is set so that the side wall portion 32*c* of the insert pin 3 invades therein when a part of the insert pin 3 is inserted up to a predetermined position of the insertion/removal space portion 7.

Further, an engaged/disengaged portion 9 having a fallen J shape constituted of an oblique rising portion 9*a* and a horizontal portion 9*b* with/from which the other part of the insert pin 3 is engaged and disengaged, is formed integrally on the wall face of the partition wall 8 opposite to the insertion/removal space portion 7 such that the engaged/disengaged portion 9 is projected forward. The bottom face position of the notch portion 8*a* and the top face position of the horizontal portion 9*b* of the engaged/disengaged portion 9 are located on an identical plane. Therefore, the cutout depth of the notch portion 8*a* is extended from the top face of the box 1 to the top face position of the horizontal portion 9*b*. The side edge on the notch portion 8*a* side of the partition wall 8 is located on the box pin 2 side with respect to the engaged/disengaged portion 9, and the side edge is located between an engaging/disengaging portion 32*b* and a box insertion/removal portion 32*a* in a state in which the engaging/disengaging portion 32*b* is engaged with the engaged/disengaged portion 9.

Figure 2:
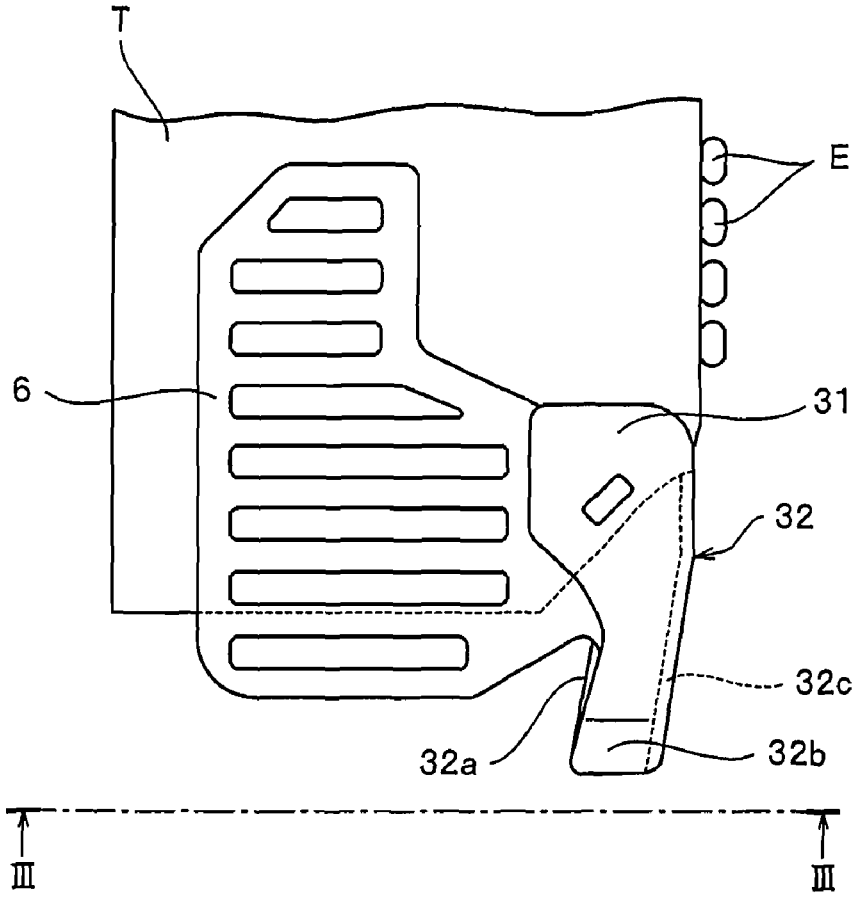
FIG. 2 is a front view of a box pin on the separable end stop mounting end portion.
Figure 3:
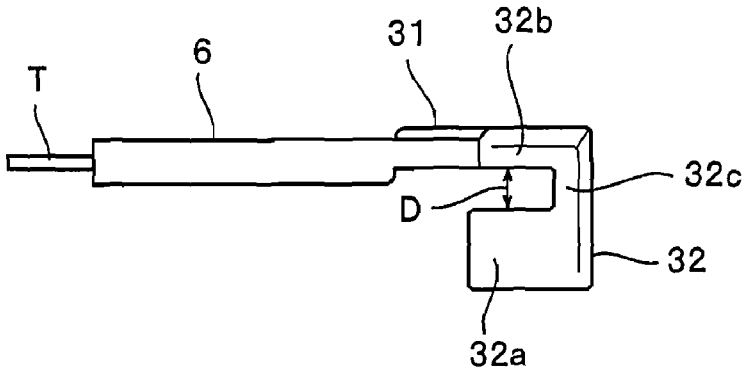
FIG. 3 is a view taken along the line III-III in FIG. 2.

As shown in FIGS. 1 to 3, the insert pin 3 is attached to one end of the fastener tape T by integral molding adjacent to the fastener element E of the fastener tape T. According to the present invention, the insert pin 3 has a characteristic structure which can be combined with the characteristic structure of the box 1. As shown in FIG. 3, a proximal portion 31 of the insert pin 3 is formed integrally at an end portion of the fastener tape T, and the insert pin main body 32 is formed into a substantially fallen letter J cross section which follows the folding shape of the J-shaped folded edge portion 4 at the fastener tape end portion, and extended outward in the tape length direction from the fastener tape end. The folded edge portion 4 at the fastener tape end is buried in the insert pin 3 along the inner face of the insert pin 3 formed with a fallen letter U shaped section.

The insert pin main body 32 extending from an end portion of the fastener tape t is comprised of the box insertion/removal portion 32*a* which is inserted into and removed from the insert pin insertion/removal space 7 of the box 1; the engaging/disengaging portion 32*b* which engages and disengages from the engaged/disengaged portion 9 of the box; and a side wall portion 32*c* which connects the box insertion/removal portion 32*a* and the engaging/disengaging portion 32*b* disposed in parallel to and apart therefrom through a side end on the element attaching edge portion side. A distance D between the inside faces of the box insertion/removal portion 32*a* and the engaging/disengaging portion 32*b* is set to a dimension which allows the box insertion/removal portion 32*a* and the engaging/disengaging portion 32*b* to sandwich the partition wall 8 of the box 1. That is, the distance D between the inside faces is set larger than the thickness of the partition wall 8. The engaging/disengaging portion 32*b* and the box insertion/removal portion 32*a* are of the same length, that is, have the same bottom end position.

Figure 4:
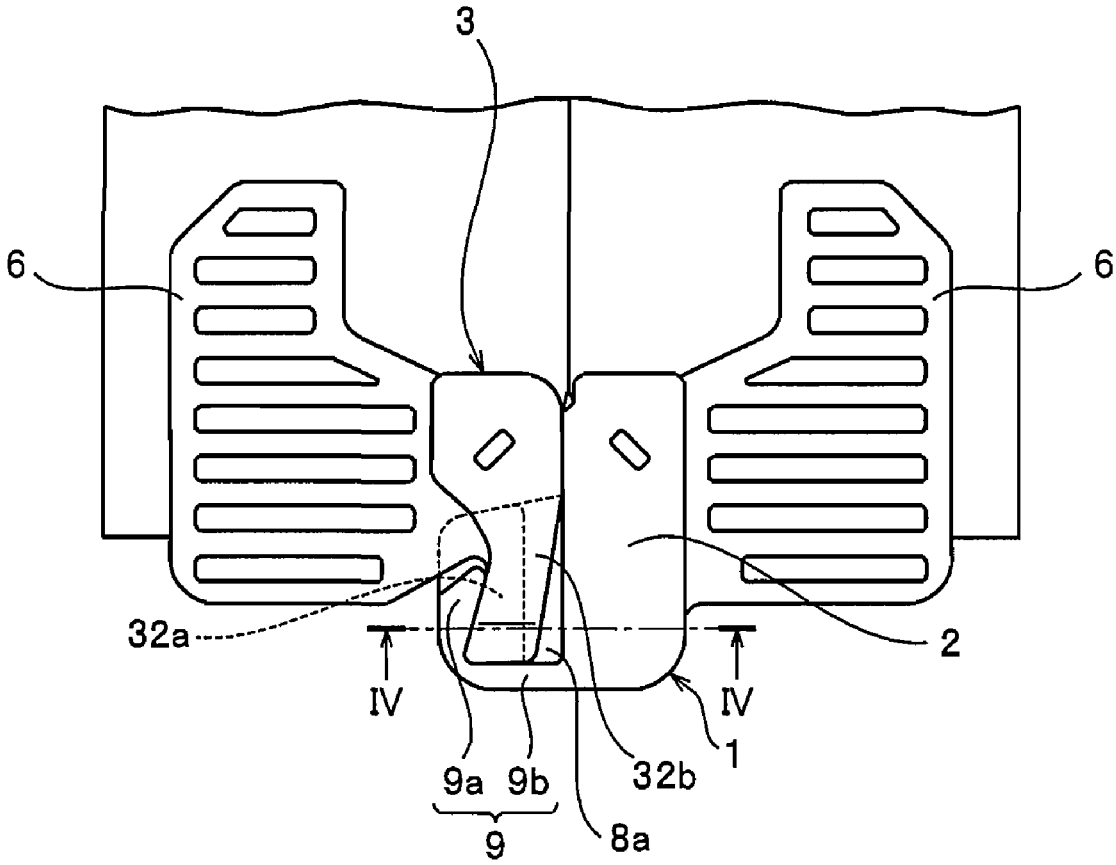
FIG. 4 is a front view of the separable end stop as seen from an engaging/disengaging side when an insert pin is inserted into a box.

The box insertion/removal portion 32*a* and the engaging/disengaging portion 32*b* present a rectangular column like shape as shown in FIG. 3 and are extended toward the front end from the proximal portion 31 such that the portions 32*a* and 32*b* are tilted slightly toward the main body side of the fastener tape T. The inclination angle of the side face of the engaging/disengaging portion 32*b* on the tape main body side is set larger than those of the box insertion/removal portion 32*a* and the entire engaging/disengaging portion 32*b*. The sectional shape of the box insertion/removal portion 32*a* is of substantially square shape which can be inserted in/removed from the insert pin insertion/removal space 7 of the box 1, and the sectional shape of the engaging/disengaging portion 32*b* is of flat rectangular shape. When the insert pin is inserted into the box 1 as shown in FIG. 4, the engaging/disengaging portion 32*b* is engaged with the inclined side face on the box pin side of the engaged/disengaged portion 9 making contact with the side face opposite to the box pin 2. Thus, the inclination angle of the inclined side face on the box pin side which serves as an engaging face of the oblique rising portion 9*a* of the engaged/disengaged portion 9 with respect to the engaging/disengaging portion 32*b* is set equal to the inclination angle of the tape main body engaging/disengaging side face of the engaging/disengaging portion 32*b*. Further, the engaging/disengaging portion 32*b* is formed to be in thinner inclined shape as it goes toward the front end thereof.

The side wall portion 32*c* of the insert pin 3 has at least a length equal to the entire length of the engaging/disengaging portion 32*b*, and the thickness thereof is set to a dimension which allows itself to be inserted into the notch portion 8*a* formed in the partition wall 8 of the box 1. Since the lengths of the side wall portion 32*c* and the engaging/disengaging portion 32*b* are equal entirely, the side wall portion 32*c* is formed up to the front end of the engaging/disengaging portion 32*b*. Therefore, the notch portion 8*a* guides the side wall portion 32*c* throughout its entire length when the insert pin 3 is inserted into the box 1. To reinforce the insert pin attaching end portion of the fastener tape T, the lateral grid-like reinforcing portion 6 is formed integrally to extend from the engaging/disengaging portion 32*b* of the insert pin 3 on the surface of the folding edge portion 4 at the fastener tape end portion on the tape main body side. The insert pin 3 and the reinforcing portion 6 are formed at the same time such that they are integrated as shown in FIG. 1.

Figure 6:
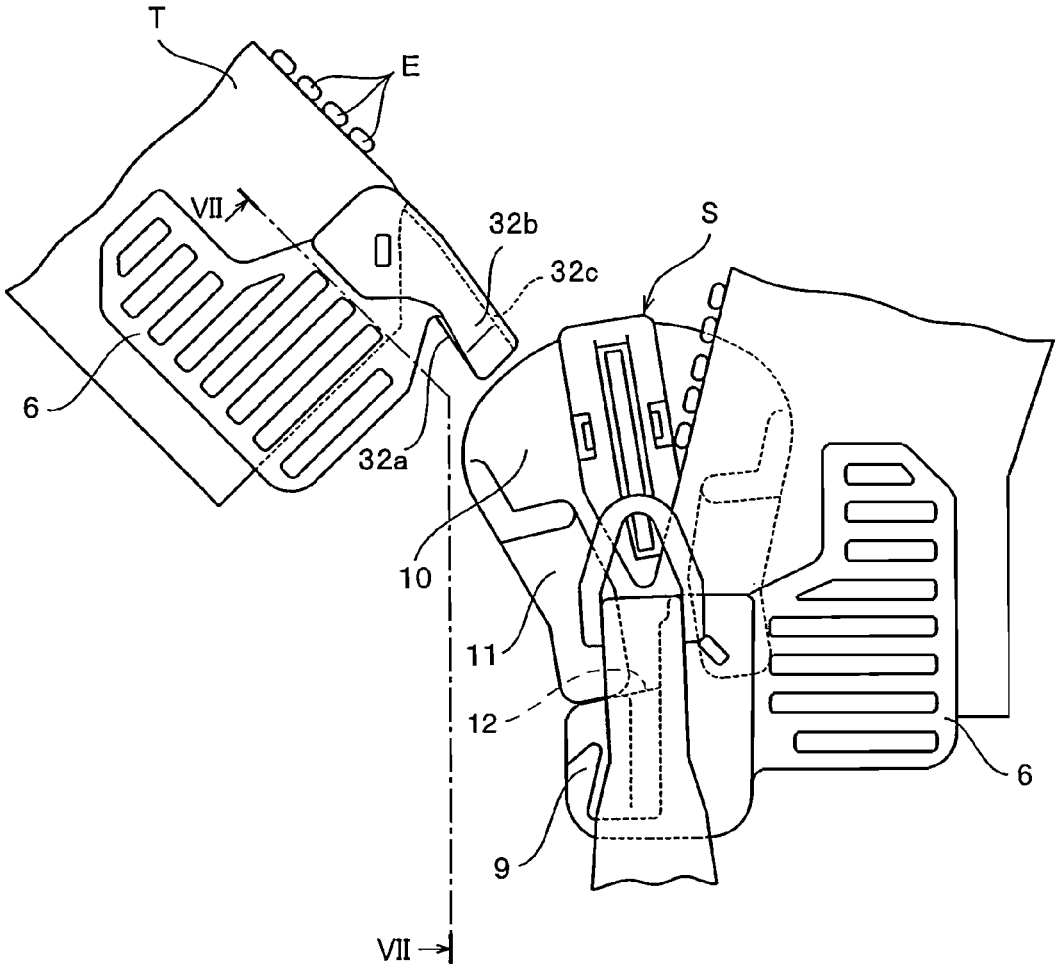
FIG. 6 is a front view showing a state in which the insert pin of the separable end stop is inserted.
Figure 7:
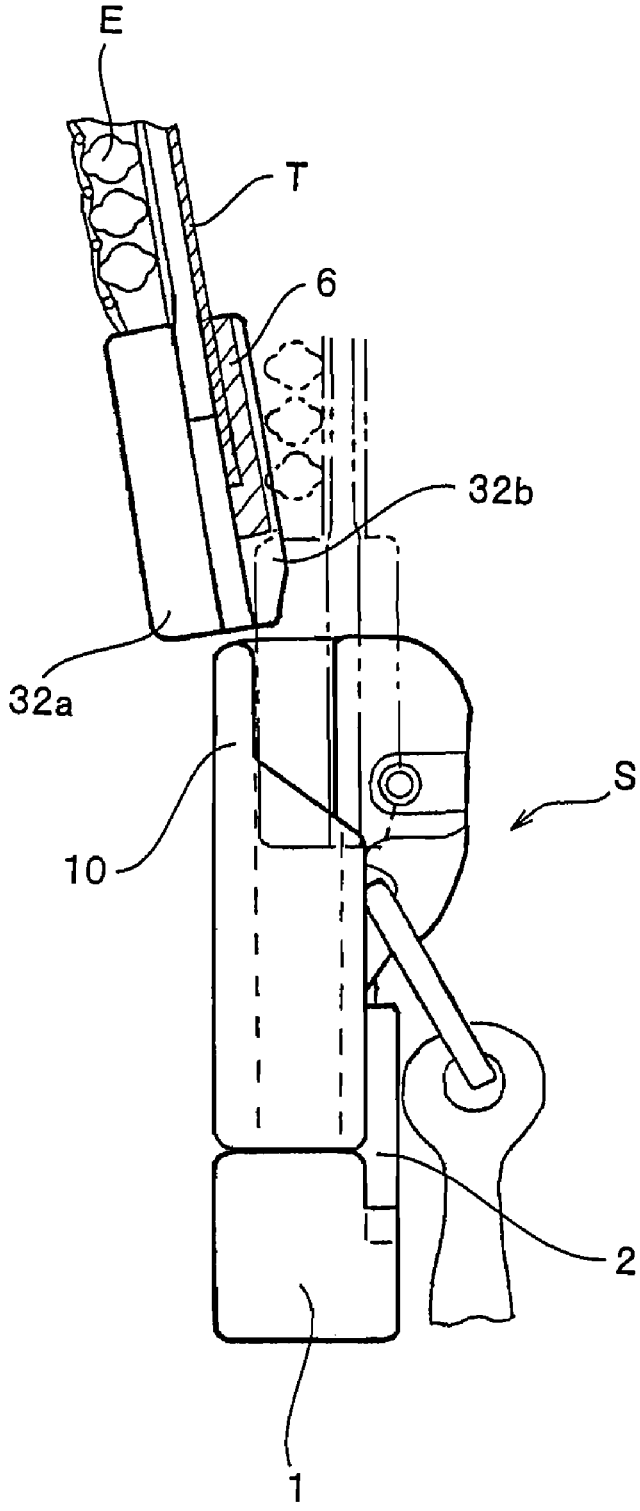
FIG. 7 is a view taken along the line VII-VII in FIG. 6.

When connecting the separable insert pin of the concealed type slide fastener with the separable insert pin having the above-described structure, as shown in FIGS. 6 and 7, the box insertion/removal portion 32*a* of the insert pin 3 is inserted into a guide space formed between a lower blade 10 of a slider S and a flange 11 on a side in which the box pin 2 is not passed through of a pair of flanges 11 rising in an L shape configuration from the right and left side edges. Further, with the engaging/disengaging portion 32*b* of the insert pin 3 placed on the outside surface of the flange 1, the insert pin 3 is inserted through the slider S such that the flange 11 is sandwiched by the box insertion/removal portion 32*a* and the engaging/disengaging portion 32*b*.

After the insert pin 3 is inserted through the slider S, at the same time when the box insertion/removal portion 32*a* of the insert pin 3 is inserted into the insert pin insertion/removal space 7 in the box 1, the insert pin 3 is pushed in until the engaging/disengaging portion 32*b* engages the engaged/disengaged portion 9 of the box 1 such that the box insertion/removal portion 32*a* and the engaging/disengaging portion 32*b* stride over the partition wall 8 of the box 1. After the insert pin 3 is inserted through the interior of the slider S, it is inserted into the insert pin insertion/removal space 7. According to this embodiment, because the top face of the box 1 is formed into an inclined face 12 as shown in FIG. 6, the slider S making contact with the top face of the box 1 is inclined, thereby facilitating the insertion operation. Particularly, according to the present invention, the side wall portion 32*c* for connecting the box insertion/removal portion 32*a* and the engaging/disengaging portion 32*b* of the insert pin 3 is provided at least on the entire length of the engaging/disengaging portion 32*b*. Thus, existence of the side wall portion 32*c* blocks the box insertion/removal portion 32*a* and the engaging/disengaging portion 32*b* from catching the lower blade of the slider S when the insert pin 3 is inserted through the slider S. As a result, the insertion operation of the slider S is facilitated, and a rupture between the box insertion/removal portion 32*a* and the engaging/disengaging portion 32*b* which is ever generated is eliminated.

According to the present invention, the insert pin 3 is provided with the side wall portion 32*c*, and the notch portion 8*a* for guiding the side wall portion 32*c* over its entire length is formed at an end portion of the partition wall 8 of the box 1. With this structure, such a fault that the lower blade 10 of the slider S is caught between the box insertion/removal portion 32*a* and the engaging/disengaging portion 32*b* is eliminated, and such a fault that the operability upon inserting the insert pin 3 into the box 1 is lost or the engaging/disengaging/disengaging portion 32*a* is damaged is also eliminated. When the insertion of the insert pin 3 into the box 1 is finished, the inclined face of the engaging/disengaging portion 32*b* of the insert pin 3 and the inclined side face of the engaged/disengaged portion 9 of the box 1 automatically make contact with each other and engage each other so as to eliminate clearance between the box 1 and the insert pin 3.

Figure 5:
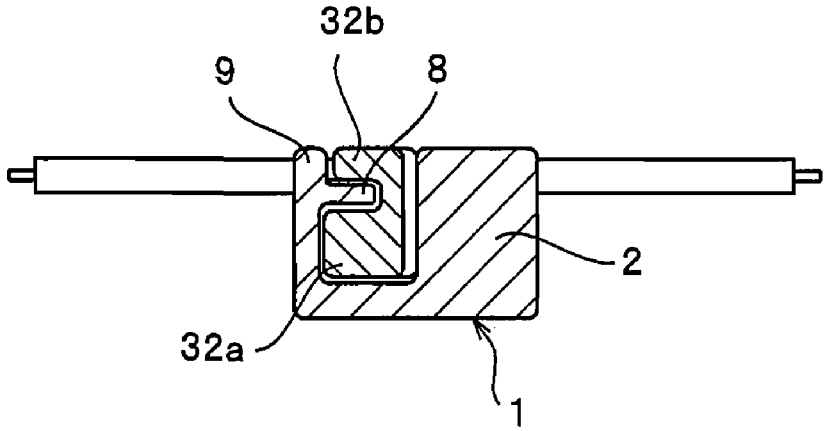
FIG. 5 is a sectional view taken along the line IV-IV in FIG. 4.

Additionally, even if a large force (upward pushing force) perpendicular to the fastener tape is applied between the box 1 and the insert pin 3 after the insertion of the insert pin 3 into the box 1 is finished, the insert pin 3 is never deformed in a direction that the box insertion/removal portion 32*a* and the engaging/disengaging portion 32*b* depart from each other. This maintains a stable insertion condition to the box 1 of the insert pin 3, so that the insert pin 3 never slips out of the box 1. Consequently, as shown in FIG. 5, the end portion of the partition wall 8 opposes the side wall portion 32*c* of the insert pin 3 throughout its entire length. Further, existence of the side wall portion 32*c* blocks the box insertion/removal portion 32*a* from rolling inside the insert pin insertion/removal space 7 even if any external force is applied in a lateral direction to the separable end stop as understood from FIG. 5.

Figure 8:
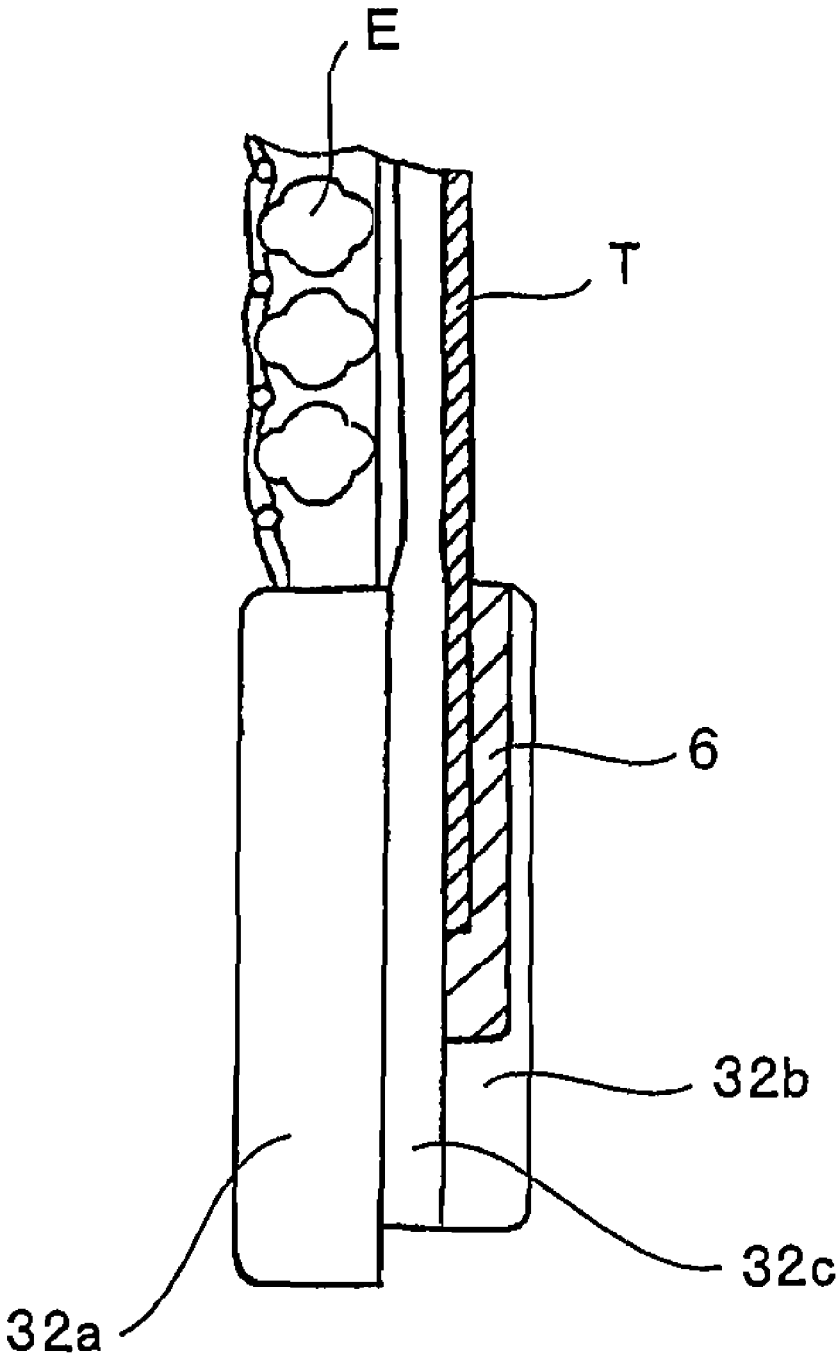
FIG. 8 is a partial sectional view showing a modification of the insert pin.

FIG. 8 shows a modification of the insert pin 3. According to this modification, the box insertion/removal portion 32*a* of the insert pin 3 is formed longer than the engaging/disengaging portion 32*b* and at the same time, the side wall portion 32*c* is formed in an equal length to the engaging/disengaging portion 32*b* so as to connect the engaging/disengaging portion 32*b* to the box insertion/removal portion 32*a* throughout the entire length thereof. Also in this example, existence of the side wall portion 32*c* prevents the lower blade 10 of the slider S from being caught by the box insertion/removal portion 32*a* and the engaging/disengaging portion 32*b* like the above-described embodiment. In addition, the box insertion/removal portion 32*a* or the engaging/disengaging portion 32*b* is never caught by the partition wall 8 of the box 1.

What is claimed is:

1. A concealed type slide fastener provided with a separable end stop including:

a box integrally molded on a fastener tape of a fastener tape pair extending from one end portion in a length direction of the fastener tape of a fastener stringer in which opposing side edge portions of the pair of fastener tapes are bent into a U shape along the length direction thereof and a plurality of fastener elements are attached along a folding end portion;

a box pin fixed to the box; and an insert pin that is insertable into the box, wherein the box comprises an insert pin insertion/removal space into/from which a first part of the insert pin is inserted and removed, and an engaged/disengaged portion with/from which the second part of the insert pin is engaged and disengaged, the first part of the insert pin is a box insertion/removal portion which is inserted into and removed from the insert pin insertion/removal space of the box, the second part of the insert pin is an engaging/disengaging portion which is disposed in parallel to the box insertion/removal portion with a gap and is engaged with and disengaged from the engaged/disengaged portion, the insert pin insertion/removal space and the engaged/disengaged portion of the box are disposed to be separated from each other through a partition wall, tape folding end sides of the box insertion/removal portion and the engaging/disengaging portion of the insert pin are connected by a side wall portion throughout at least an entire length in a longitudinal direction to a bottom end of the engaging/disengaging portion, and a notch portion for guiding the side wall portion of the insert pin throughout an entire length in a longitudinal direction to a bottom end of the side wall portion is provided at an end portion of the partition wall of the box on the box pin side.

2. The concealed type slide fastener according to claim 1, wherein a dimension of the gap between the box insertion/removal portion and the engaging/disengaging portion of the insert pin is set larger than a thickness of the partition wall of the box.

3. The concealed type slide fastener according to claim 1, wherein the partition wall of the box is inserted between the box insertion/removal portion and the engaging/disengaging portion of the insert pin, so that a side edge of the notch portion of the partition wall opposes the side wall portion.

* * * * *